US008755724B2

(12) United States Patent
Sasaki

(10) Patent No.: US 8,755,724 B2
(45) Date of Patent: Jun. 17, 2014

(54) FIXING DEVICE AND IMAGE FORMING APPARATUS

(75) Inventor: Yoshikuni Sasaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/346,971

(22) Filed: Jan. 10, 2012

(65) Prior Publication Data

US 2012/0195653 A1 Aug. 2, 2012

(30) Foreign Application Priority Data

Jan. 30, 2011 (JP) ..... 2011-017348

(51) Int. Cl.
*G03G 15/20* (2006.01)

(52) U.S. Cl.
CPC ..... *G03G 15/20* (2013.01); *G03G 15/2075* (2013.01); *G03G 15/2064* (2013.01); *G03G 2215/00531* (2013.01); *G03G 2215/1695* (2013.01)
USPC ..... 399/327; 399/174; 399/326; 399/338; 399/350

(58) Field of Classification Search
CPC ..... G03G 15/20
USPC ..... 399/174, 326–327, 338, 350
See application file for complete search history.

(56) References Cited

U.S. PATENT DOCUMENTS

| | | | | |
|---|---|---|---|---|
| 5,742,873 | A * | 4/1998 | Kubo et al. | 399/98 |
| 2002/0018663 | A1 * | 2/2002 | Furukawa et al. | 399/69 |
| 2007/0134034 | A1 * | 6/2007 | Kitami et al. | 399/328 |
| 2008/0226363 | A1 * | 9/2008 | Tateishi et al. | 399/327 |
| 2013/0045031 | A1 * | 2/2013 | Nagata et al. | 399/327 |
| 2013/0148999 | A1 * | 6/2013 | Sugino et al. | 399/94 |

FOREIGN PATENT DOCUMENTS

| | | | |
|---|---|---|---|
| CN | 1627206 | A | 6/2005 |
| CN | 1752867 | A | 3/2006 |
| CN | 100346242 | C | 10/2007 |
| CN | 101122772 | A | 2/2008 |
| JP | 06-242701 | | 9/1994 |
| JP | 3612976 | | 11/2004 |
| JP | 2006-317881 | * | 11/2006 |
| JP | 2006-330434 | | 12/2006 |

OTHER PUBLICATIONS

Office Action mailed Jan. 23, 2014 in Chinese Patent Application No. 201210019700.6 (with English Translation).

* cited by examiner

*Primary Examiner* — Clayton E Laballe
*Assistant Examiner* — Kevin Butler
(74) *Attorney, Agent, or Firm* — Oblon, Spivak, McClelland, Maier & Neustadt, L.L.P.

(57) ABSTRACT

A fixing device including: an endless fixing belt that conveys a sheet-like medium having a toner image formed thereon; a heating member on which the fixing belt is wound and which includes a heater therein; a fixing member on which the fixing belt is wound; a pressing member that is disposed so as to face the fixing member with the fixing belt interposed therebetween; a separator that comes into contact with the surface of the pressing member and prevents the sheet-like medium from being wound on the pressing member; and a polisher that polishes the surface of the pressing member.

7 Claims, 3 Drawing Sheets

FIXING DEVICE AND IMAGE FORMING APPARATUS

CROSS-REFERENCE TO RELATED APPLICATIONS

The present application claims priority to and incorporates by reference the entire contents of Japanese Patent Application No. 2011-017348 filed in Japan on Jan. 30, 2011.

BACKGROUND OF THE INVENTION

1. Field of the Invention

The present invention generally relates to a fixing device and an image forming apparatus including the same.

2. Description of the Related Art

In high-speed image forming apparatuses, a pair of rollers which respectively serve as a fixing member and a pressing member and form a nip portion therebetween is generally formed as large-diameter rollers for the purpose of preventing a fixing failure caused by a drop in the temperature of a fixing device during continuous conveyance of paper or improving durability. In recent years, in order to prevent a fixing belt from being scratched when a separator for separating paper from the fixing belt comes into contact with the fixing belt, there is a known fixing device in which a member forming a fixing member is formed so as to have mild hardness, a pressing member bites into the fixing member so that paper is easily separated from a fixing belt, and a separator near the fixing belt is configured such that it does not come into contact with the fixing belt.

In such a fixing device, when a printing process is performed on both of the faces of a sheet of paper, a toner image formed on a first face may stick to the pressing member when a toner image is fixed to a second face, so that the paper is wound around the pressing member.

In order to prevent such a phenomenon, a contact-type separator is adopted for the separator on the pressing member side. A coating layer of PFA or a tube coating is formed on a surface layer of the pressing member to improve the separation property of toner. However, the surface layer of the pressing member is soft and easily scratched by the contact-type separator. If the surface of the pressing member is scratched, the toner image formed on the first face once is softened again by heat accumulated in the pressing member when the paper is conveyed through a nip portion while the first face comes into contact with the pressing member at the time of performing both-side printing. Accordingly, the scratches on the surface of the pressing member are transferred to the toner image, and a problem arises in that a stripe-like abnormal image is generated.

Japanese Patent Application Laid-open No. 2006-330434 discloses a technique in which air is forcedly sent into a pressing member in a hollow pipe shape to cool the pressing member so that the temperature of the pressing member does not increase. Further, Japanese Patent No. 3612976 discloses a technique in which a cooling fan is disposed around a pressing member to cool the pressing member so that the temperature of the pressing member does not increase. Japanese Patent Application Laid-open No. H06-242701 discloses a technique in which a pressing member and a fixing member are respectively set at different temperatures and rotate while they are separated from each other.

In the configuration of Japanese Patent Application Laid-open No. 2006-330434 in which the pressing member is cooled from its inside, it takes time for the surface of the pressing member to cool, and the surface temperature of the pressing member is not easily controlled. Further, since an air blowing path to the inside of the pressing member needs to be ensured, there is concern that the fixing device may increase in size. In the configuration of Japanese Patent No. 3612976 in which the pressing member is cooled by the cooling fan, there is concern of heat pollution which means a phenomenon that hot air generated after cooling diffuses into the apparatus and thus the value of a temperature sensor is out of control. In the configuration of Japanese Patent Application Laid-open No. H06-242701 in which the pressing member and the fixing member are separated from each other, since the temperature of the pressing member gradually increases during the continuous printing process, it is necessary to take measures such as stopping the printing process and separating the pressing member from the fixing member. As a result, the productivity significantly decreases.

There is a need to provide a high-quality image which does not include a stripe-like abnormal image by reducing scratches of a pressing member generated by a separation pawl to an inconspicuous degree without cooling a pressing member.

SUMMARY OF THE INVENTION

It is an object of the present invention to at least partially solve the problems in the conventional technology.

A fixing device including: an endless fixing belt that conveys a sheet-like medium having a toner image formed thereon; a heating member on which the fixing belt is wound and which includes a heater therein; a fixing member on which the fixing belt is wound; a pressing member that is disposed so as to face the fixing member with the fixing belt interposed therebetween; a separator that comes into contact with the surface of the pressing member and prevents the sheet-like medium from being wound on the pressing member; and a polisher that polishes the surface of the pressing member.

A fixing device including: an endless fixing belt that conveys a sheet-like medium having a toner image formed thereon; a heating member on which the fixing belt is wound and in which a heater is included; a fixing member on which the fixing belt is wound; a pressing member that is disposed so as to face the fixing member with the fixing belt interposed therebetween; a separator that comes into contact with the surface of the pressing member and prevents the sheet-like medium from becoming wound on the pressing member; and a cleaner that removes a residual material such as residual toner or paper powder on the surface of the pressing member, wherein the cleaner has a polishing function of polishing the surface of the pressing member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
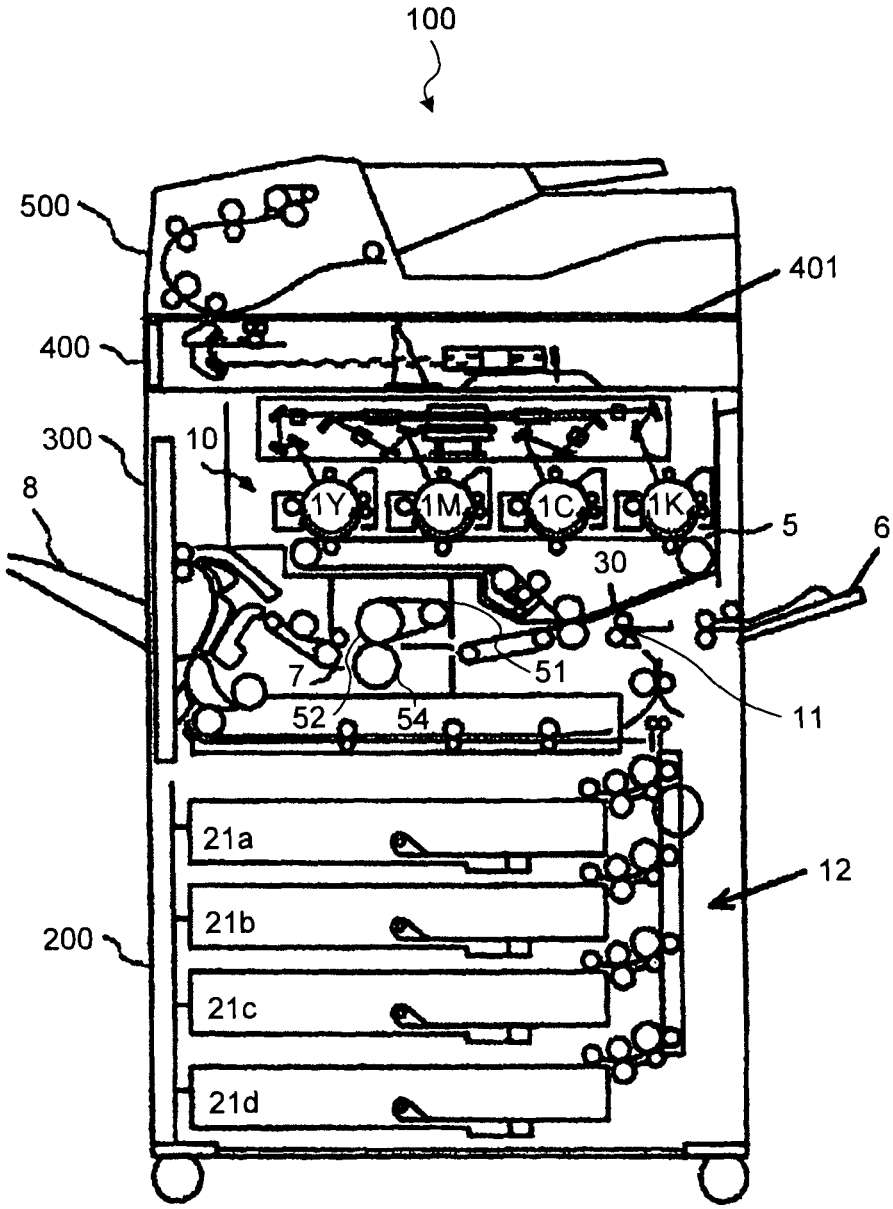
FIG. 1 is a longitudinal sectional front view schematically illustrating the entire configuration of a full-color image forming apparatus corresponding to a subject to which the invention is applied.

A device according to a first embodiment of the invention is a fixing device including: an endless fixing belt that conveys a sheet-like medium having a toner image formed thereon; a heating member on which the fixing belt is wound and which includes a heater therein; a fixing member on which the fixing belt is wound; a pressing member that is disposed so as to face the fixing member with the fixing belt interposed therebetween; and a separator that comes into contact with the surface of the pressing member and prevents the sheet-like medium from being wound on the pressing member. This device further includes a polisher that polishes the surface of the pressing member scratched by the separator and polishes the surface of the pressing member so that the scratches may be reduced to an inconspicuous degree. With such a configuration, even when the surface of the pressing member is scratched by the separator, the scratches may be reduced to an inconspicuous degree by polishing the surface of the pressing member.

The device according to the embodiment further includes: a cleaner that removes residual materials such as residual toner and paper powder from the surface of the pressing member. The polisher is disposed downstream of the cleaner. Accordingly, the polisher may be prevented from being degraded due to foreign matters such as residual toner and paper powder.

Further, a device according to a second embodiment of the invention is a fixing device including: an endless fixing belt that conveys a sheet-like medium having a toner image formed thereon; a heating member on which the fixing belt is wound and which includes a heater therein; a fixing member on which the fixing belt is wound; a pressing member that is disposed so as to face the fixing member with the fixing belt interposed therebetween; a separator that comes into contact with the surface of the pressing member and prevents the sheet-like medium from being wound on the pressing member; and a cleaner that removes residual materials such as residual toner and paper powder from the surface of the pressing member. In addition, the cleaner has a polishing function of polishing the surface of the pressing member, thereby polishing the surface of the pressing member scratched by the separator and reducing the scratches to an inconspicuous degree without further providing a dedicated polishing mechanism.

In the device according to the embodiment, the web-like cleaner contains a polishing agent used to polish the surface of the pressing member, thereby polishing the surface of the pressing member scratched by the separator and reducing the scratches to be an inconspicuous degree.

Further, in the device according to the embodiment, the fiber of the web-like cleaning member forming the cleaner is equipped with a function of polishing the surface of the pressing member, thereby polishing the surface of the pressing member scratched by the separator and reducing the scratches to an inconspicuous degree.

Both the devices according to the first and second embodiments may provide an image forming apparatus without generating an abnormal image.

EXAMPLE

FIG. 1 is a longitudinal sectional front view schematically illustrating the entire configuration of a full-color image forming apparatus as a subject to which the invention is applied. An image forming apparatus 100 of this example is a tandem type (juxtaposition type) full-color image forming apparatus using electrophotography. An image forming unit (a printer engine) 300 which serves as an image forming device is disposed at the center of the apparatus main body, and a paper feeding unit 200 which serves as a paper feeding device is disposed directly therebelow. The paper feeding unit 200 is provided with, for example, four stages of paper cassettes 21*a* to 21*d* which respectively serve as paper accommodating units. The paper cassettes 21*a* to 21*d* are configured to be freely drawn out and accommodated in the front-rear direction (the direction moving close to or away from the paper surface in the drawing) with respect to the apparatus main body of the image forming apparatus 100. Further, a reading unit (scanner) 400 which reads a document image is disposed above the printer engine 300. Furthermore, a discharge tray 8 to which paper subjected to an image forming process is discharged is provided downstream (the left side of the drawing) of the printer engine 300 in the paper conveying direction. Furthermore, an input tray 6 which serves as a paper accommodating unit for manually feeding paper is provided upstream (the right side of the drawing) of the printer engine 300 in the paper conveying direction.

In the printer engine 300, four image forming units for yellow (Y), cyan (C), magenta (M), and black (K) are arranged in parallel above an intermediate transfer belt 30 formed as an endless belt which constitutes a paper transfer unit 5. In the respective image forming units, electrophotography processing members or electrophotography processing units such as a charging unit, an optical writing unit, a developing unit, and a cleaning unit are arranged along the outer peripheries of drum-like photosensitive elements 1Y to 1K for respective colors.

Although not illustrated in detail, the charging unit performs a charging process on the surfaces of the photosensitive elements 1Y to 1K, and forms image information on the surface of the photosensitive element through the irradiation of a laser beam from an optical writing unit. The developing unit develops an electrostatic latent image, which is formed on the surface of the photosensitive element through the exposure as a toner image, and the cleaning unit removes and collects toner or the like remaining on the surfaces of the photosensitive elements 1Y to 1K after the transfer process. Then, the images of the respective colors are sequentially formed on the intermediate transfer belt 30, and the four colors are superimposed on the intermediate transfer belt 30, thereby forming one color image. At that time, first, the Y-image forming unit develops a Y-toner image, and transfers the developed image onto the intermediate transfer belt 30. Next, the C-image forming unit develops a C-toner image, and transfers the developed image onto the intermediate transfer belt 30. Then, an M-toner image is developed and transferred onto the intermediate transfer belt, and finally a K-toner image is developed and transferred onto the intermediate transfer belt, thereby forming a full color toner image in which four colors are superimposed. Then, four colors of toner images which have been transferred onto the intermediate transfer belt 30 are transferred onto transfer paper fed from a paper feeding unit 200 by the paper transfer unit 5, the transferred toner images are fixed by the fixing unit, and then the transfer paper having the toner images thereon is discharged to the discharge tray 8 by a discharging roller. Meanwhile, after the full-color toner image is transferred onto the transfer paper, toner or the like remaining on the surface of the intermediate transfer belt 30 is removed and collected by a belt cleaning unit.

The paper feeding unit 200 includes four stages of paper cassettes 21*a* to 21*d* which hold transfer paper set by a user in a stacked state as described above, and the paper size and the paper type set for the respective paper cassettes 21*a* to 21*d* may be set by a user. Further, a unit may be provided which automatically sets the conditions of the respective paper cassettes 21*a* to 21*d* by automatically determining the paper size, the paper type, or the paper thickness based on the position of a side fence for evenly arranging the transfer paper inside the respective paper cassettes 21*a* to 21*d* or a resistance measuring device for measuring the resistance of the stacked paper. The respective paper cassettes 21*a* to 21*d*, the input tray 6, and the registration roller 11 are connected to each other by a conveying path 12, and the transfer paper which is fed from an arbitrary feeding position is conveyed to a registration roller 11 through the conveying path 12. The registration roller 11 first stops the conveying of the transfer paper and sends the transfer paper to the paper transfer unit at a timing in which the toner image on the intermediate transfer belt 30 and the front end of the transfer paper have a predetermined positional relation. The registration roller 11 performs the same process on the transfer paper conveyed from the input tray 6.

This is also not specifically illustrated in the drawings. However, in the scanner 400, a plurality of traveling bodies each equipped with a document illuminating light source and a mirror move in a reciprocating manner so as to read and scan a document placed on a contact glass 401. The image information scanned by the traveling bodies is collected by a lens onto an imaging plane of a CCD installed at the rear side, and is read as an image signal by the CCD. The read image signal is digitalized and is image-processed. Then, an optical writing process is performed on the surface of the photosensitive element by light emitted from a laser diode LD inside the optical writing unit based on the image-processed signal, so that an electrostatic latent image is formed. The optical signal generated from the LD reaches the photosensitive element through a polygon mirror or a lens. Further, an automatic document feeder which automatically conveys a document onto the contact glass is installed at the upper portion of the scanner.

Example 1

Example of the invention will be described by referring to FIG. 2.

Figure 2:
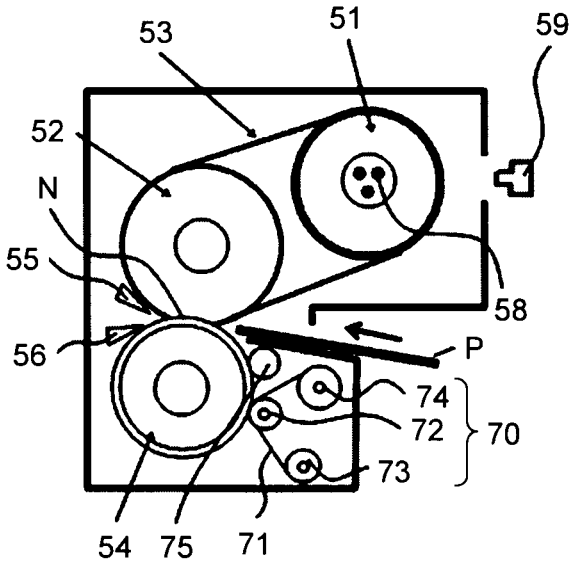
FIG. 2 is a cross-sectional view illustrating Example 1 of the invention.

In the fixing device illustrated in FIG. 2, an endless fixing belt 53 is wound on a heating roller 51 and a fixing roller 52. A pressing roller 54 is disposed so that the pressing roller 54 is able to apply and release a pressure to and from the fixing roller 52 with the fixing belt 53 interposed therebetween by a press-contact mechanism (not illustrated). When the pressing roller 54 is pressed, a nip portion N is formed between the pressing roller 54 and the fixing roller 52. The heating roller 51 includes a cored bar portion and a surface releasing layer such as Teflon (registered trademark), and a heater 58 is provided at an axial center hole of the cored bar portion.

In this example, for example, the fixing roller 52 is obtained by forming silicon rubber with a thickness of several tens of micrometers on the cored bar. The fixing belt 53 is obtained by forming a silicon rubber layer on a base material made from polyimide and coating a surface layer with PFA. The pressing roller 54 is obtained by forming a silicon rubber layer with a thickness of several mm on a cored bar and coating a surface layer with PFA tube.

The silicon rubber layer of the fixing roller 52 is formed to be sufficiently thicker than the silicon rubber layer of the pressing roller 54 and formed of rubber having mild hardness. Accordingly, the paper may be easily separated from the fixing belt 53 in a manner such that the pressing roller 54 bites into the fixing roller 52. For this reason, a fixing separation pawl 55 serving as a separator, which is configured to prevent the paper from becoming wound on the fixing belt 53 is disposed so as not to come into contact with the fixing belt 53. This is merely an example, and various materials may be combined with each other depending on the purpose, the use, and the like.

The heat of the heating roller 51 is transmitted to the fixing belt 53, and the surface temperature of the fixing belt 53 is detected by a temperature detecting device 59 (for example, a thermistor or a thermopile). Then, the heater 58 is controlled so that it is turned on and off so that it can obtain a constant temperature (for example, 135 to 180° C.). A pressure separation pawl 56 serving as a separator, which is configured to come into contact with the surface of the pressing roller 54 and prevent the paper from becoming wound on the pressing roller 54, comes into contact with a cleaning unit 70 at the downstream of the nip portion N. A polisher 7 which polishes the surface of the pressing roller 54 is disposed downstream of the cleaning unit 70.

The operation of the fixing device of this example will be described.

Recording paper P having a toner image as an unfixed image loaded thereon is conveyed in the direction depicted by the arrow, and the toner image is fixed through heat and pressure at the nip portion N formed between the fixing roller 52 and the pressing roller 54 with the fixing belt 53 interposed therebetween. Then, when an image is formed on both faces of the recording paper P, a toner image is fixed onto a first face by passing the recording paper through the nip portion N once, the recording paper is reversed in the conveying path (not illustrated), a toner image as an unfixed image is loaded on a second face while the first face comes into contact with the pressing roller 54, and the recording paper is conveyed to the nip portion N again, so that an image is fixed thereto. Here, the toner image on the first face of the recording paper P is softened by the heat accumulated in the pressing roller 54, and sticks to the pressing roller 54. The recording paper P sticking to the pressing roller 54 is separated from the pressing roller 54 at the pressure separation pawl 56 near the exit of the nip portion N, and is conveyed to the subsequent process by a discharger (not illustrated). Since the pressure separation pawl 56 is disposed so as to come into contact with the pressing roller 54 at a contact pressure of about 30 mN/mm by a pressing mechanism such as a spring (not illustrated), scratches may be generated on the surface of the pressing roller 54.

Residual materials such as residual toner and paper powder which are transferred from the fixing belt 53 are attached to the surface of the pressing roller 54 through which the recording paper P has passed. Such residual materials are removed and collected by the cleaning unit 70. The cleaning unit 70 includes a cleaning web 71 and a cleaning web contact member 72. A winding shaft 73 and a supply shaft 74 are attached to the cleaning web 71, and the cleaning web 71 is wound thereon by a driving mechanism (not illustrated). The cleaning web 71 is formed in a scroll shape with a thickness of about several tens of micrometers, and is brought into contact with the pressing roller 54 by the cleaning web contact member 72.

Next, the pressing roller 54 from which the residual material is removed is polished by a polisher 75 which is disposed over the entire paper passing area of the pressing roller 54 so that the surface thereof has appropriate surface roughness. Since polishing eliminates scratches from the surface of the pressing roller 54 generated by the contact with a pressure separation pawl 56 and a difference in surface roughness of the surface of the pressing roller 54 other than the contact portion that comes in contact with the pressure separation pawl 56 and may reduce the scratches to an inconspicuous degree, generation of a stripe-like abnormal image can be suppressed. In this example, the pressure separation pawl 56 is brought into contact with the pressing roller 54 at a contact pressure of about 30 mN/mm. However, in this case, when the surface roughness is set to be about Ra=0.04±0.015 μm, the scratches generated by the pressure separation pawl 56 can be reduced to an inconspicuous degree.

Example 2

Figure 3:
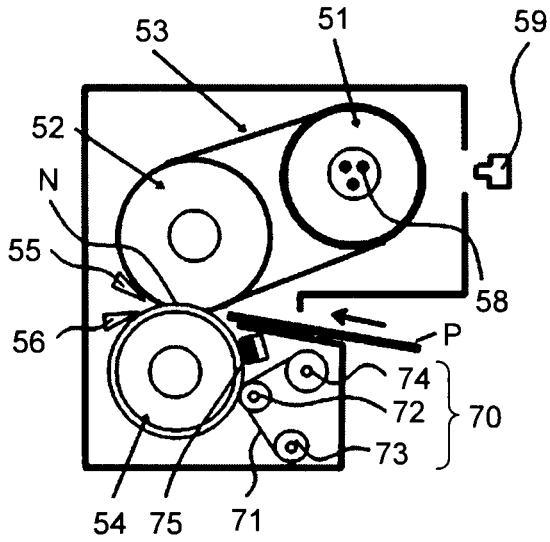
FIG. 3 is a cross-sectional view illustrating Example 2 of the invention.

Here, the polisher 75 is formed in a roll shape which has a circular cross-section in FIG. 2, but the shape is not limited thereto if the polishing may be performed with appropriate surface roughness. For example, a brush shape illustrated in FIG. 3 may be adopted.

Example 3

Figure 4:
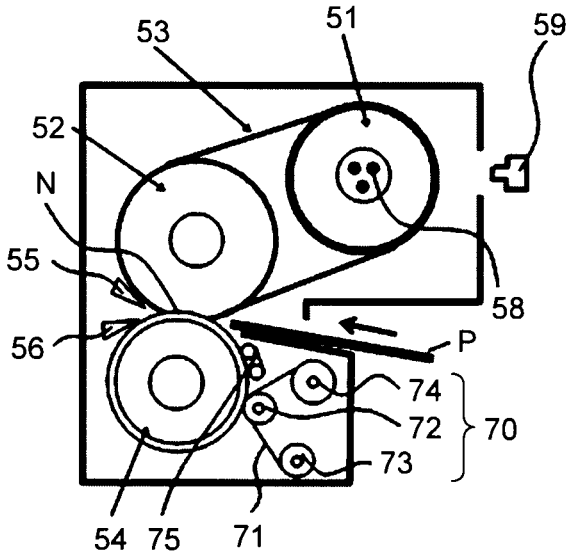
FIG. 4 is a cross-sectional view illustrating Example 3 of the invention.

Further, the polisher 75 may have a belt shape as illustrated in FIG. 4.

Example 4

Figure 5:
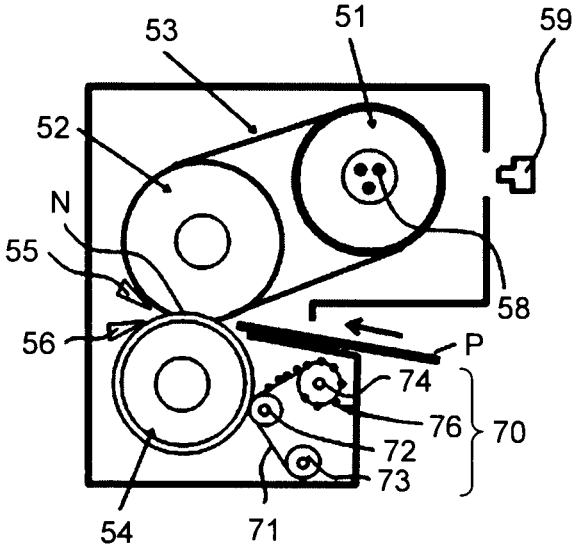
FIG. 5 is a cross-sectional view illustrating Example 4 of the invention.

Further, in the fixing device illustrated in FIG. 5, since the cleaning web 71 contains a polishing agent 76, the surface of the pressing roller 54 may be polished without further providing a dedicated polisher. Also, since scratches of the surface of the pressing roller 54 generated by contact with a pressure separation pawl 56 and a difference in surface roughness of the surface of the pressing roller 54 other than the contact portion of the pressure separation pawl 56 can be eliminated and the scratches can be reduced to an inconspicuous degree, generation of a stripe-like abnormal image can be suppressed. Further, the fiber can be made to function as a polishing member to polish the surface of the pressing roller 54 by adjusting the shape, the thickness, the density, and the like of the fiber forming the cleaning web 71. Even in this configuration, generation of a stripe-like abnormal image can be suppressed in the same way.

According to the invention, the scratches of the pressing member generated by the separation pawl can be reduced to an inconspicuous degree without cooling the pressing member, and hence a high-quality image which does not contain a stripe-like abnormal image may be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an endless fixing belt that conveys a sheet-like medium having a toner image formed thereon;

a heating member on which the fixing belt is wound and which includes a heater therein;

a fixing member on which the fixing belt is wound;

a pressing member that is disposed so as to face the fixing member with the fixing belt interposed therebetween;

a separator that comes into contact with the surface of the pressing member and prevents the sheet-like medium from being wound on the pressing member; and a polisher that polishes the surface of the pressing member by eliminating scratches from the surface of the pressing member.

2. The fixing device according to claim 1, further comprising:

a cleaner that removes a residual material such as residual toner or paper powder on the surface of the pressing member, wherein the polisher is disposed downstream of the cleaner.

3. An image forming apparatus comprising:

the fixing device according to claim 1.

4. A fixing device comprising:

an endless fixing belt that conveys a sheet-like medium having a toner image formed thereon;

a heating member on which the fixing belt is wound and in which a heater is included;

a fixing member on which the fixing belt is wound;

a pressing member that is disposed so as to face the fixing member with the fixing belt interposed therebetween;

a separator that comes into contact with the surface of the pressing member and prevents the sheet-like medium from becoming wound on the pressing member; and a cleaner that removes a residual material such as residual toner or paper powder on the surface of the pressing member, wherein the cleaner has a polishing function of polishing the surface of the pressing member by eliminating scratches from the surface of the pressing member.

5. The fixing device according to claim 4, wherein the cleaner has a web shape and contains a polishing agent used to polish the surface of the pressing member.

6. The fixing device according to claim 4, wherein the cleaner has a web shape and polishes the surface of the pressing member using fiber forming the web.

7. An image forming apparatus comprising:

the fixing device according to claim 4.

* * * * *